United States Patent [19]

Freudlsperger

[11] 3,985,237

[45] Oct. 12, 1976

[54] DEVICE TO RAISE AND LOWER BOX-SHAPED CONSTRUCTION ELEMENTS, IN PARTICULAR PREFABRICATED GARAGES

[76] Inventor: Fritz Freudlsperger, Pallaufstr. 5a, D-8262 Neuotting, Germany

[22] Filed: Apr. 18, 1975

[21] Appl. No.: 569,475

[30] Foreign Application Priority Data

July 23, 1974 Germany ..... 2435369

[52] U.S. Cl. ..... 214/1 H; 52/749; 214/1 D

[51] Int. Cl.[2] ..... B60P 3/14; E04H 1/04

[58] Field of Search ..... 214/1 H, 1 D; 52/745, 52/749

[56] References Cited

UNITED STATES PATENTS 3,929,241 12/1975 Putnam ..... 214/1 H

FOREIGN PATENTS OR APPLICATIONS 920,101 3/1963 United Kingdom ..... 214/1 D

*Primary Examiner*—Robert J. Spar
*Assistant Examiner*—George F. Abraham

[57] ABSTRACT

A device to raise and lower box-shaped construction elements with the elements having at least three openings in the floor; the device including lifting cylinders designed to pass through the openings, a lifting plate mounted perpendicular to the cylinder walls and an inclined plate designed to support the construction elements.

12 Claims, 13 Drawing Figures

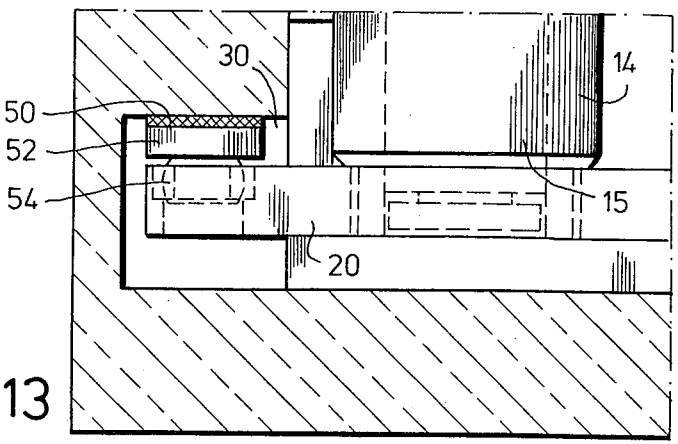
Fig. 13
Fig. 11
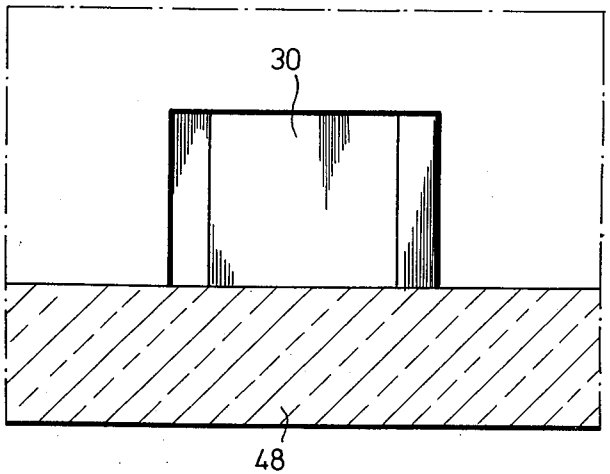
Fig. 12
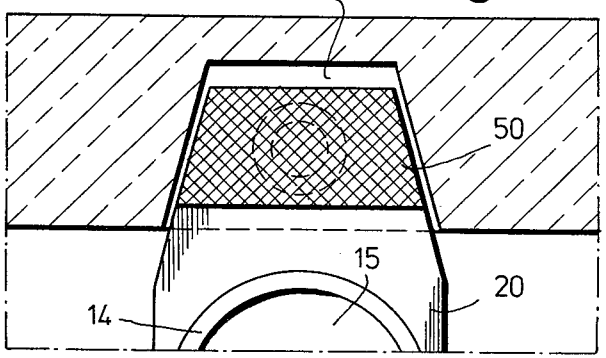

DEVICE TO RAISE AND LOWER BOX-SHAPED CONSTRUCTION ELEMENTS, IN PARTICULAR PREFABRICATED GARAGES

The invention relates to a device to raise and lower box-shaped construction elements, in particular prefabricated garages which exhibit at least three openings in the floor to allow passage of lifting cylinders. The lifting device is mobile and at its corners provided with lifting cylinders which in the extended position will pass through the openings in the building floor.

A device as mentioned before should be designed in such a way that it can be used efficiently on one side, can be operated by a single person on the other and in addition minimizes the physical labor required.

According to the invention, this will be achieved by a lifting plate mounted perpendicularly to the lower end of each lifting cylinder and by an inclined plate on the other end of the said cylinder. In combination with a wedge, this plate will be placed against the wall of a prefabricated garage.

Now the sole requirement is one cavity for each hole in the garage floor. As a result of this design, a single lifting plate on one side of the cylinder is provided with an inclined plate supporting the flat garage wall. Critical dimensions between two cavities do not exist, because the inclined plate can be positioned at any distance away from the lifting plate. It is significant to mention that the wall support is adjustable to a certain extent, because the inserted wedge between inclined plate and wall can be repositioned.

To compensate for unevenness and to increase the friction, the lifting plate and the inclined plate are covered with a rubber lining.

A pressure plate is loosely supported on the lifting plate by utilizing a universal joint so that the pressure plate can adapt itself to the mating area inside the cavity.

The mounting of the lifting plate on the cylinder wall is by means of threading.

While on one side the pressure plate supported by the lifting plate is covered by a rubber lining, the opposite side preferably exhibits a caster wheel. This permits to positioning the cylinder as closely as possible to the garage wall cavity in a simple manner.

The positioning of the lifting cylinder on one side and a positive support on the other will be improved by tapering the cavity and the pressure plate.

In a preferred embodiment, the wheels of the lifting vehicle can be adjusted in height individually.

The piston rods of the lifting cylinders can be provided at their lower ends with a base plate coupled by a universal joint. Preferably the universal joint permits only minor angular movement.

Preferably the wheels of the lifting vehicle rotate 90° automatically if it is lowered.

For this rotation, a control rod can be provided connecting the wheel fork and the adjacent side of lifting vehicle frame. The control rod is mounted on the fork and fastened to the frame via a ball joint.

An alternate design for a controlled 90° rotation of the wheels could be achieved by a wheel mount adapted to a helical vertical rod.

Furthermore, the required mold work will be reduced according to the invention because only one cavity is required which additionally is easy to form because of its tapered contour. The garage structure itself will be utilized to hold and align the respective lifting cylinder.

Because of the above-mentioned rotation of the wheels, the thrust into that former direction will be eliminated. To position the lifting cylinder above the floor openings the frame can be rolled easily into the proper place.

The caster wheel attached to the lifting plate will loose contact to the floor when the rubber lining touches the cavity (during the downward movement of the piston rod).

In the design according to the invention, the heavy cylinders don't have to be carried, the hydraulic hoses don't have to be connected every time, one person is adequate to operate it. Expensive threaded plates can be eliminated, cracks and high strain of the garage as well as buckling piston rods do not occur.

The piston rods moreover are guided by the holes in the garage floor, because these holes are only slightly larger than the piston rod diameter, about 3 to 4 cm.

According to the invention it is possible to balance the lifting vehicle with a level and to adjust the cylinders and wheels individually up and down as required.

Preferred embodiments of the invention are explained on hand of the attached drawings on which FIG. 1 shows a side view of a vehicle with the device according to the invention including a prefabricated garage;

FIG. 11 shows a detail as seen from the interior of the structure to be moved;

FIG. 12 is a horizontal sectional view through the detail shown in FIG. 11 and FIG. 13 shows a section of an important detail of the invention.

Figure 1:
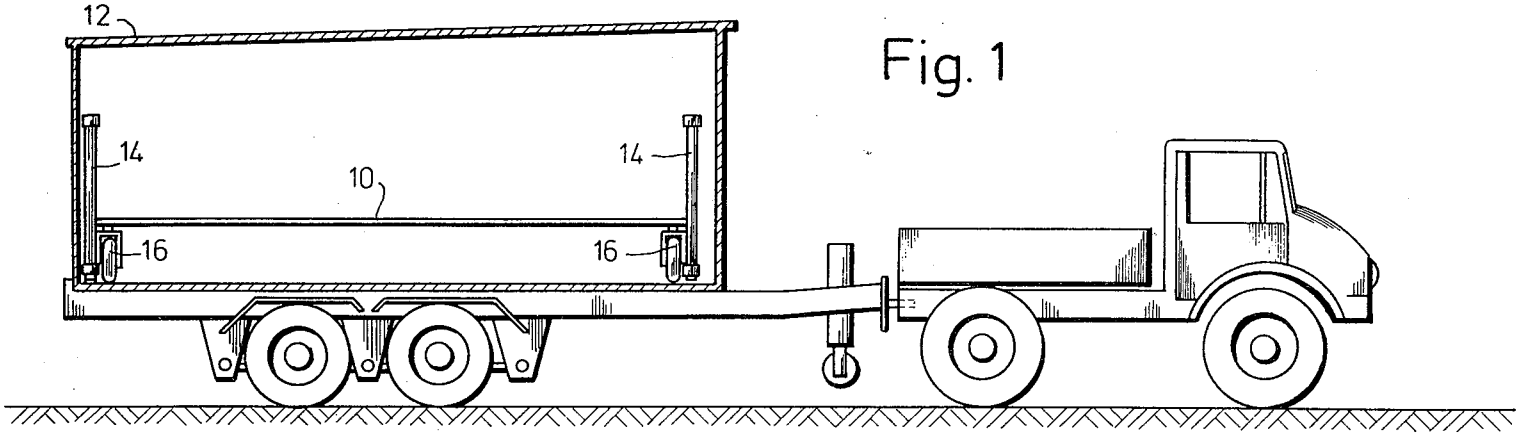
Figure 2:
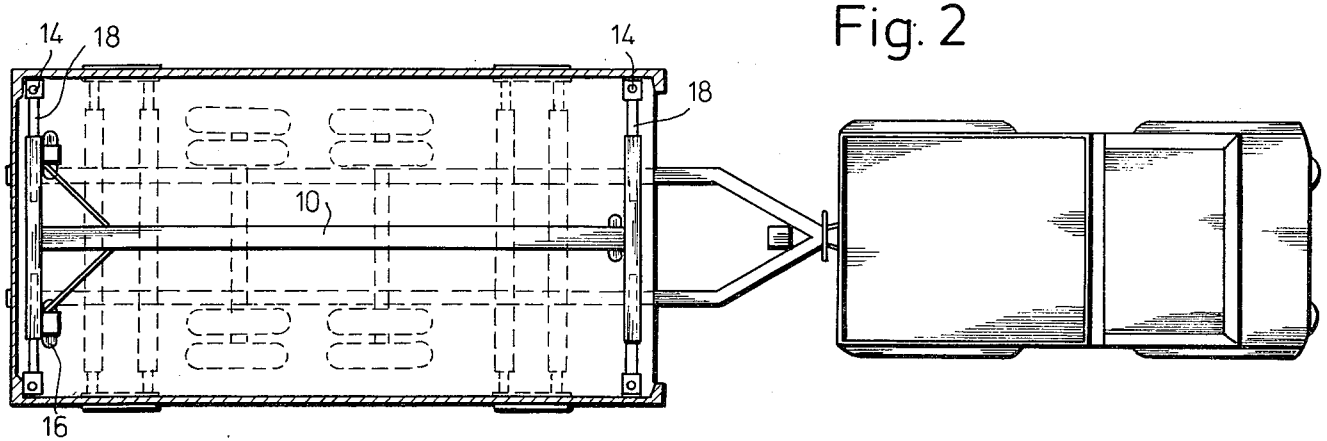
FIG. 2 is a top view of FIG. 1.

According to FIGS. 1 and 2 of the drawings one can recognize a known vehicle pulling a trailer which carries a prefabricated garage 12 within it there is a lifting vehicle 10 according to the invention. The vertical lifting cylinders 14 and the adjustable wheels 16 are clearly shown.

Mounted on vehicle frame 10 are two telescoping horizontal cylinders 18 holding the prefabricated garage on one side and the vertical lifting cylinders 14 on the other. Shown in dotted lines is the telescoping support of the trailer.

Figures 3, 4:
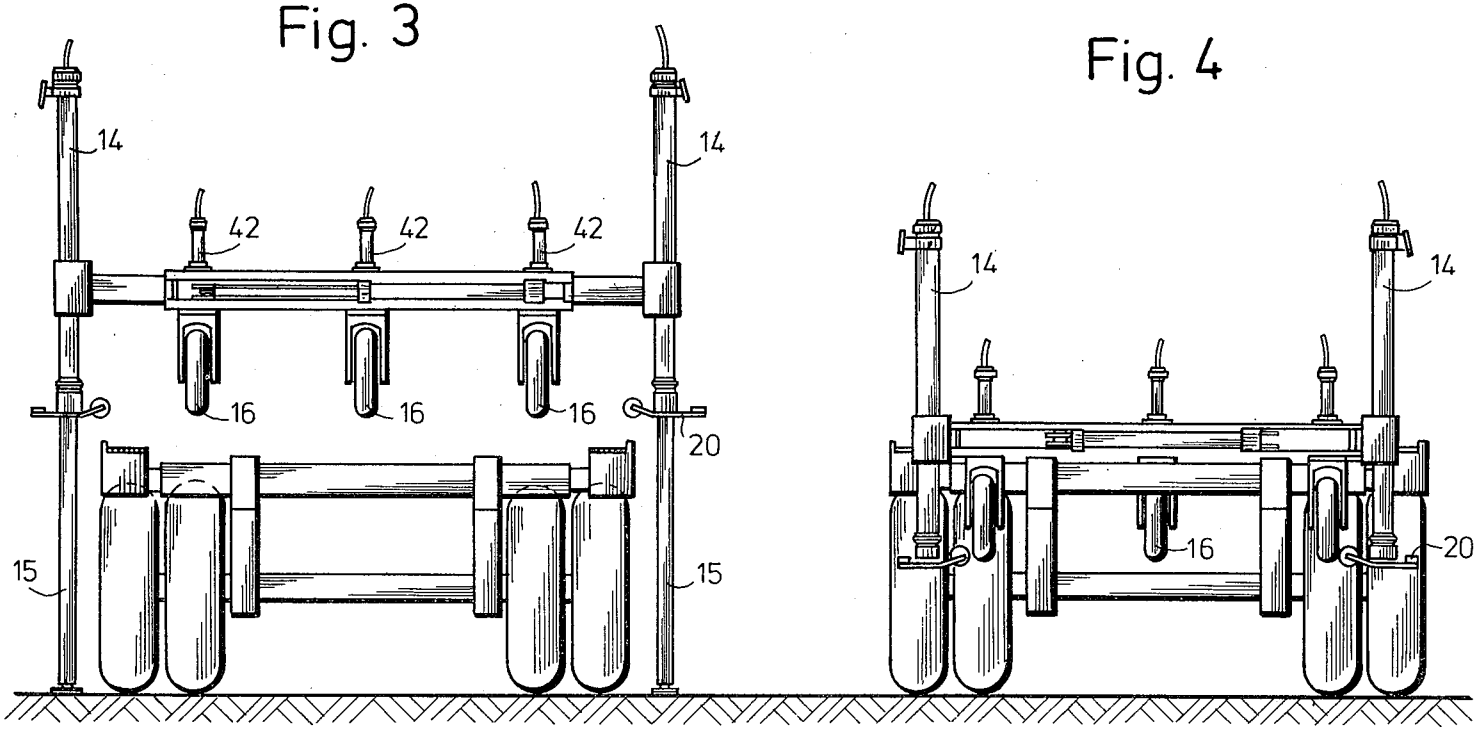
FIG. 3 is a rear view of FIG. 1 before the vehicle is loaded on the trailer.
FIG. 4 shows a lifting vehicle in its mobile position (rear view)

FIGS. 3 and 4 shows in more detail the lifting vehicle. It is a rear view of the unloaded vehicle. The piston rods 15 of lifting cylinder 14 are extended. The hydraulic connections to the wheels 16 which are adjustable in height can be recognized. The lifting vehicle is provided with three wheels. In FIG. 3 the vehicle is shown with extended cylinders as far as the width is concerned. The lifting plates to be discussed in more detail later are identified by number 20. FIG. 4 shows the lifting vehicle in its mobile state on the trailer with retracted pistons. The force required to move the total structure is minimal.

Figure 5:
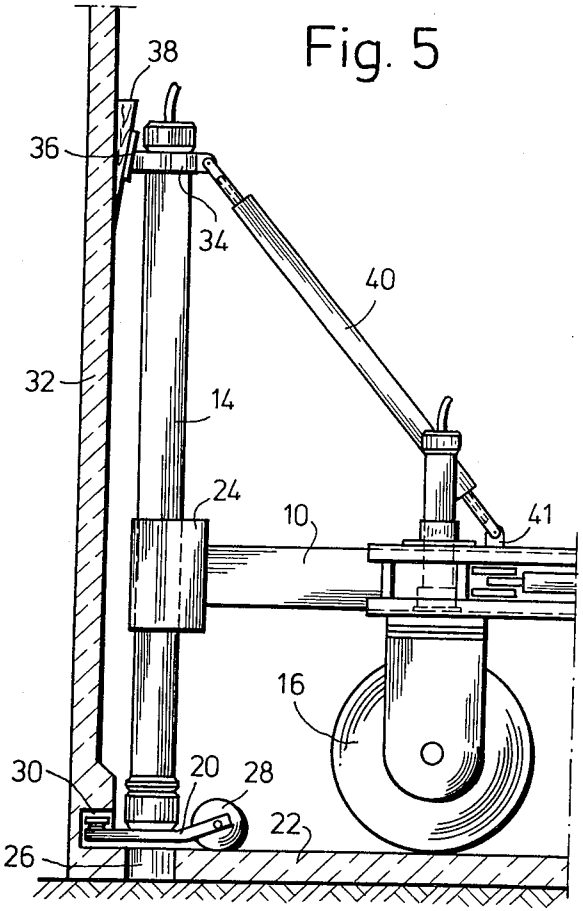
FIG. 5 shows the left rear corner of a prefabricated garage with the appropriate portion of the device according to the invention prior to lifting.

In FIG. 5 is shown the rear left corner of the lifting vehicle 10 and garage 22 respectively. Welded to the vehicle frame is a split busing 24 while the second half is mounted around lifting cylinder 14. The lifting cylinder 14 has been moved already into the cavity 26, lifting plate 20 is still disengaged, caster wheel 28 is supported by the floor making it possible to move the lifting cylinder into the cavity 30 of garage wall 32.

In a preferred embodiment, the lifting plate 20 is screwed onto the cylinder wall of the lifting cylinder.

Figure 6:
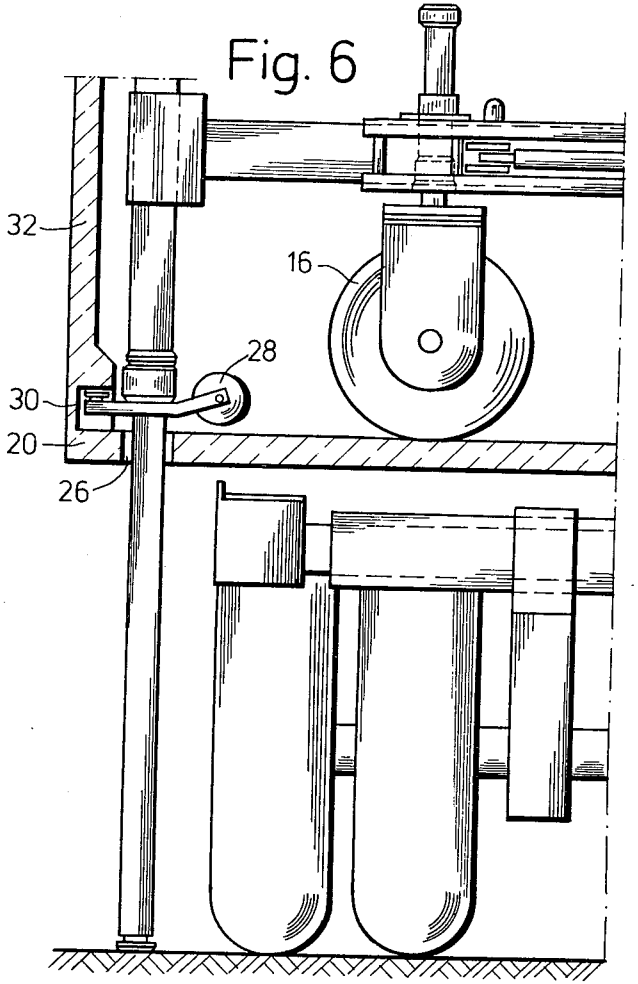
FIG. 6 is a similar view as FIG. 5, however, after lifting (extended cylinders)

On top of said lifting cylinder, a holding plate 36 is mounted on a flange 34. This plate is inclined relative to the cylinder and the garage wall. A wedge 38 has been inserted between garage wall 32 and cylinder 14. A reinforcement rod 40 is supporting the top of the cylinder against the rigid frame. A pin 41 permits disengagement of the reinforcement rod. The wheels 16 which are adjustable in height will be discussed later. After lifting the garage (FIG. 6), the lifting plate 20 is pushing against the top side of cavity 30 and caster wheel 28 is raised off the floor. Lifting plate 20 is mounted to the cylinder wall. A double acting hydraulic cylinder (FIGS. 3 + 5) not identified assures the width adjustment.

Figure 9:
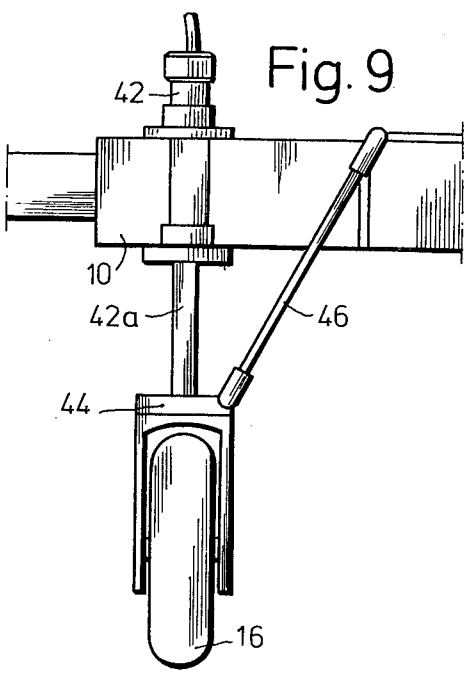
FIG. 9 shows the same as FIG. 7, however, after the wheel has been lowered.
Figure 10:
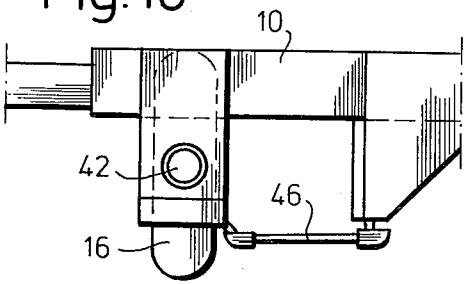
FIG. 10 is a top view of FIG. 9.
Figure 7:
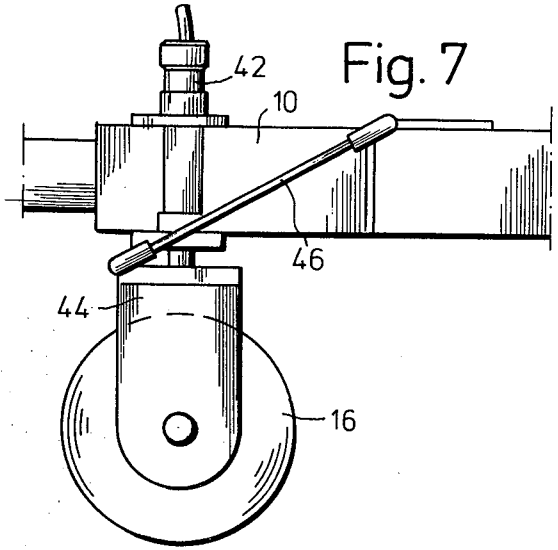
FIG. 7 shows a detail of the rotary wheel before it is lowered.
Figure 8:
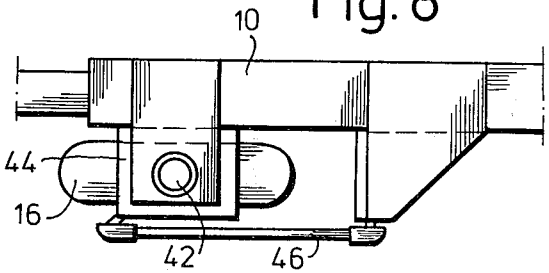
FIG. 8 is a top view of FIG. 7.

The detail shown in FIGS. 7 to 10 relates to wheel 16 which is adjustable in height. The left drawing (FIGS. 7 + 8) shows the wheel in the retracted position, the right side which is FIGS. 9 and 10 shows the wheel turned 90° into the extended position. It can be recognized that wheel 16 is adjustable in height by cylinder 42. Cylinder 42 is mounted to the side of the frame of lifting vehicle 10 and connected hydraulically but not shown here. The hydraulic control will be done in known fashion by a volume governor.

Rigidly mounted to wheel fork 44 is a control rod 46 which is connected to the frame of lifting vehicle 10 via a ball joint. This ball joint is not explained here in more detail.

When the cylinder piston will be extended, wheel fork 44 and consequently wheel 16 will be turned until it reaches a stabile condition after a 90° turn. After piston rod 42*a* of cylinder 42 reaches the extended position, the hydraulic control will be locked e.g. by closing the valves. When the cylinder is in the extended position, there is no chance for the vehicle to exert any forces on the garage side walls. On the other side, when the second cylinder will be positioned, the wheels 16 do not have to be pushed sideways across the floor.

FIGS. 11 and 12 show the cavity 30 above garage floor. The cavity is tapered, as it can be seen in FIG. 12. The pressure plate is provided with a rubber lining 50 improving the friction relative to cavity 30.

The clearance between piston and the hole in the garage floor amounts to only a few centimeters. Lifting plate 20 mounted to the cylinder supports pressure plate 52 with rubber lining 50 via a universal joint 54 having limited movement. The pressure plate, therefore, can be adjusted with respect to the top side of the cavity without exerting any forces on the cylinder (FIG. 13).

A lifting plate 20 is mounted to the cylinder or piston rod respectively according to FIG. 13. This plate is interconnected by a universal joint (not shown) to the cylinder or piston rod.

I claim:

1. Device to raise and lower box-shaped construction elements, in particular prefabricated garages which exhibit at least three openings in the floor to allow passage of lifting cylinders; including a frame structure with lifting cylinders attached thereto, a lifting plate extending perpendicularly from the wall of each said cylinder to engage a shoulder in the wall of a garage; an inclined plate attached to the opposite end of said cylinder wall capable of supporting a wall of a prefabricated garage via an inserted wedge.

2. Device according to claim 1 in which the inclined plates has rubber linings.

3. Device according to claim 1 in which the inclined plate is threaded on said cylinder wall.

4. Device according to claim 1 in which said lifting plate is covered with a rubber lining on one side and supports a caster wheel on the other side.

5. Device according to claim 4 in which the lifting plate is shaped to mate with a cavity of the prefabricated garage and is tapered along with said rubber lining.

6. Device according to claim 1 in which the lifting vehicle includes wheels which are individually adjustable in height.

7. Device according to claim 1 in which the piston rods included with said lifting cylinders support a lifting plate via a universal joint.

8. Device according to claim 7 comprising a universal joint permitting only minor movement of said lifting plate.

9. Device according to claim 7 in which the piston rod diameter of said lifting cylinder is only 3–4 cm smaller than the opening in the garage floor.

10. Device according to claim 4 in which said wheels turn automatically 90° when the lifting device is lowered.

11. Device according to claim 10 comprising a control rod between wheel fork and the frame of lifting vehicle causing the wheels to turn 90° if said wheels are lowered.

12. Device according to claim 4 in which said rubber lining has a pressure plate backing which is mounted on the lifting plate by a universal joint.

* * * * *